United States Patent [19]

Parsonage

[11] Patent Number: 4,643,822

[45] Date of Patent: Feb. 17, 1987

[54] METHOD OF SEPARATION OF MATERIAL FROM MATERIAL MIXTURES

[75] Inventor: Philip G. Parsonage, Stevenage, United Kingdom

[73] Assignee: The Secretary of State for Trade and Industry in Her Britannic Majesty's Government of the United Kingdom of Great Britain and Northern Ireland, London, England

[21] Appl. No.: 706,487

[22] Filed: Feb. 28, 1985

[51] Int. Cl.[4] ..... B03O 1/00

[52] U.S. Cl. ..... 209/8; 209/5; 209/39; 209/214

[58] Field of Search ..... 209/5, 8, 214, 39

[56] References Cited

U.S. PATENT DOCUMENTS

| | | | |
|---|---|---|---|
| Re. 30,360 | 8/1980 | Shubert | 209/8 |
| 3,032,189 | 5/1962 | Adam et al. | 209/214 X |
| 3,929,627 | 12/1975 | Frangiskos | 209/9 |
| 4,087,004 | 5/1978 | Nott | 209/9 |
| 4,125,460 | 11/1978 | Nott et al. | 209/8 |
| 4,225,425 | 9/1980 | Price | 209/5 |
| 4,225,426 | 9/1980 | Price | 209/5 |
| 4,298,169 | 11/1981 | Iwasaki | 209/5 X |
| 4,343,694 | 8/1982 | Cook | 209/9 |

OTHER PUBLICATIONS

Clay Colloid Chemistry, H. Van Olphen, 1963 Interscience Publishers, New York, pp. 55 & 56.

Article-"Magnetic Seaparation by Selective Enhancement of the Magnetic Minerals-Application to Magnesite (this paper was given at a meeting in Brazil)-1977.

*Primary Examiner*—Arthur Kellogg

*Attorney, Agent, or Firm*—Ladas & Parry

[57] ABSTRACT

A method of separating the constituent minerals of a mixture of minerals requires the introduction of fine particles of magnetic material such as finely ground particles of magnetite. The control of the zeta-potential of the minerals and particles of magnetic material provides heterocoagulation of the magnetized particles with one mineral but not the other to achieve separation. The method is ideally suitable for separating carbonates and phosphate ore and the separation process is enhanced by the addition of a surfactant such as oleate. The slurry is preferably subjected to low intensity magnetic separation to remove unattached particles of magnetic material which can be recycled to keep costs to a minimum.

19 Claims, 13 Drawing Figures

METHOD OF SEPARATION OF MATERIAL FROM MATERIAL MIXTURES

Figure 1:
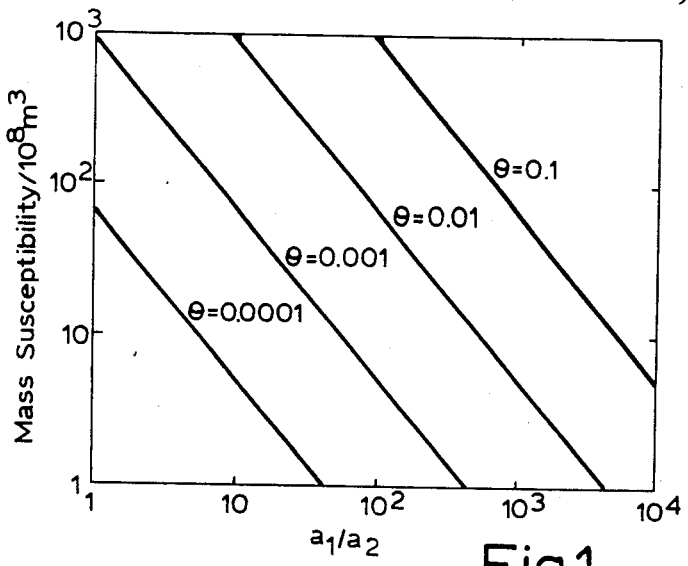

This invention relates of a method of separation of materials from material mixtures and more particularly carbonates from phosphate ore.

It is well known that modification of mineral surfaces by the adhesion of fine particles of material of a different kind may influence the response of the mineral to separation processes, especially flotation. This influence is usually deleterious, but it may consist in the formation of selective particle coatings that increase the possibility that separation will be achieved. If the absorbed species is magnetic, the selectivity of magnetic separation is improved or the possibility of promoting separation can arise where it did not otherwise exist.

The use of dispersed magnetite to absorb precipitates prior to removal by high gradient magnetic separation of solids during water treatment has been described by de Latour, (J. Am. Water Works Ass., 68, 1976, 443–6) and the absorbtion of the magnetite at submicrometer particle sizes onto titanium and iron bearing impurities in kaolin in the presence of fatty acids as a preliminary to magnetic separation has also been described in British Pat. No. 2092026 and U.S. Pat. Nos. 4,087,004 and 4,125,460. In another patent U.S. Pat. No. 3,926,789 details have been given of the separation of sulphides from silica, calcite and also of coal from ash by coating and agglomorating the values with a kerosene-based magnetic fluid. However, none of these methods have proven entirely satisfactory.

Therefore, it is desirable to improve the mechanism of coating and to define methods of controlling the coating so that the process application can be developed and thus alleviate the problems encountered with the known system.

According to one aspect of the present invention there is provided a method of separating the various constituent minerals of a mixture of mineral, comprising chemically adjusting the Zeta potential of the mixture of minerals and adding particles of magnetic material to the mixture, whereupon heterocoagulation of the magnetic particles occurs such that the product of the Zeta potentials of the individual mineral components and the Zeta potential of the magnetic material is effective to cause the magnetic particles to adhere to particles of one mineral component but not the other.

According to another aspect of the present invention there is provided a method of separating the various constituent materials of a mixture of carbonates and phosphate ore, comprising chemically adjusting the Zeta potential of the mixture of carbonates and phosphate ore, and introducing into the mixture of carbonate and phosphate ore fine particles of magnetic material such that heterocoagulation of the magnetic particles occurs when the product of the Zeta potentials of the carbonates and phosphates with the Zeta potential of the magnetic particles is such that the particles of magnetic material adhere to one of the particles of the carbonates and phosphate ore, and passing the resultant slurry through a magnetic separator to yield separated minerals consisting of magnetically coated particles of carbonates and one of said components of phosphate.

In this specification the term Zeta potential of a particle in a liquid is to be taken as being the electric potential in the known double layer at the interface between the particle which moves in an electric field and the surrounding liquid surfactant is added to the magnetite prior to the addition of the magnetite to the material mixture. Conveniently, the magnetite is ground mineral magnetite although chemically precipitated magnetite may also be used.

One method according to the present invention is ideally suited for achieving the recovery of phosphate from carbonaceous gangue although conveniently mixtures of copper/lead and quartz/fluorite can be separated.

Methods of separation according to the invention will now be described by way of example with reference to the accompanying drawings, in which, FIG. 1 illustrates the relationship between the ratio of particle size to magnetite size and magnetic susceptibility of coated particles for various surface coverages of magnetite.

Figure 2:
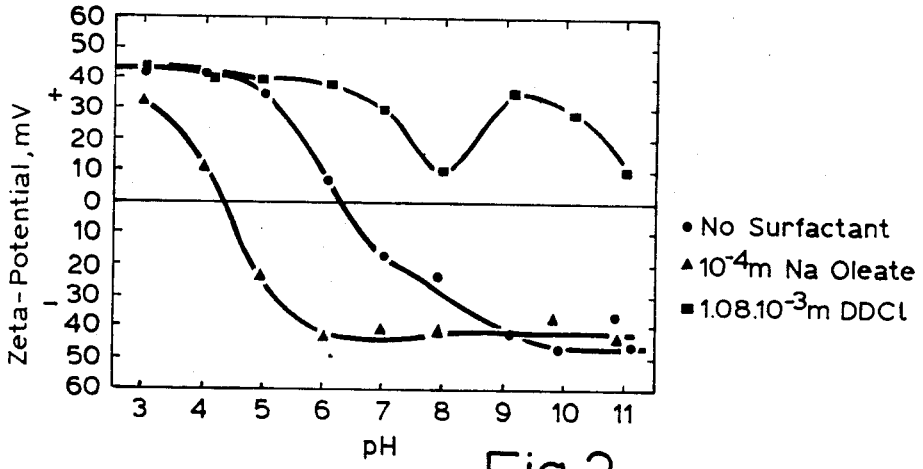
Figure 4:
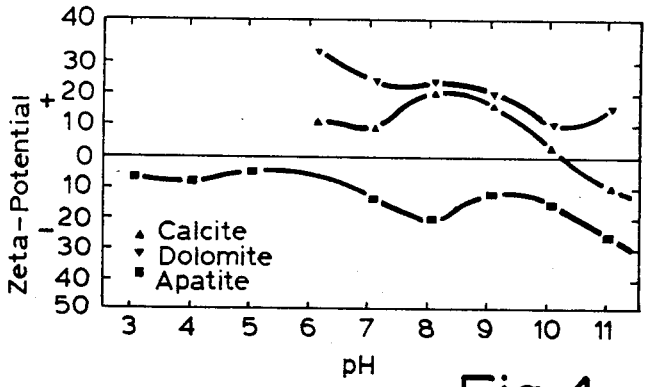
Figure 3A:
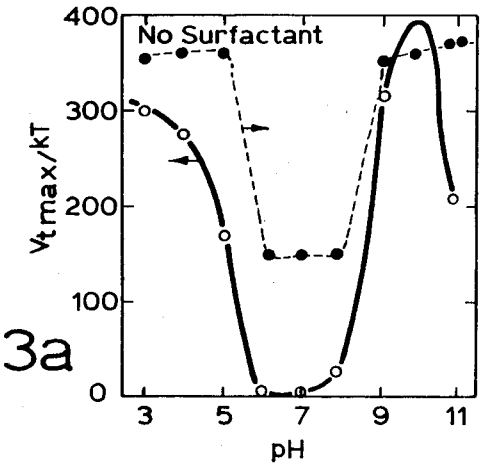
Figure 3B:
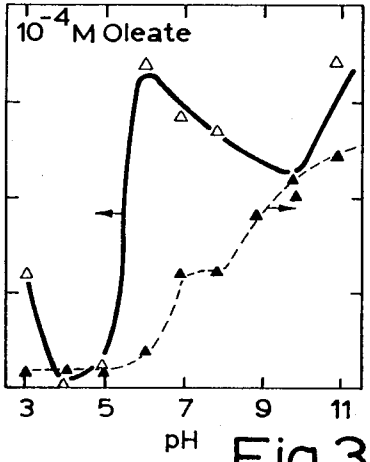
Figure 3C:
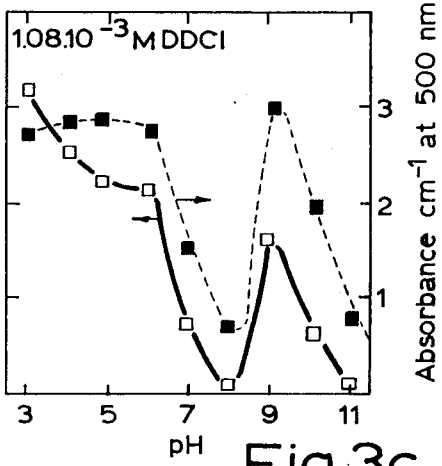
Figure 5:
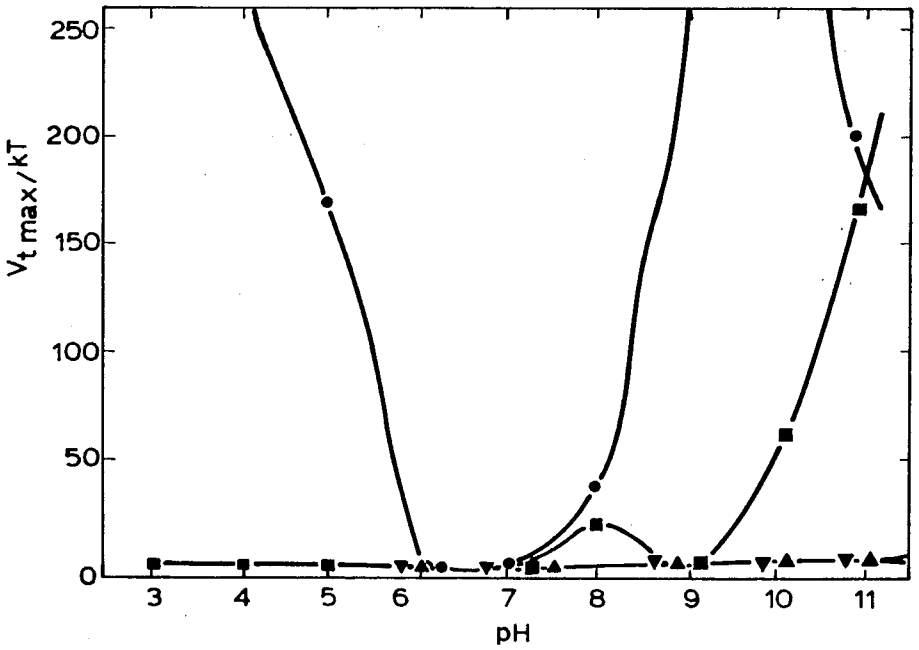
Figure 6:
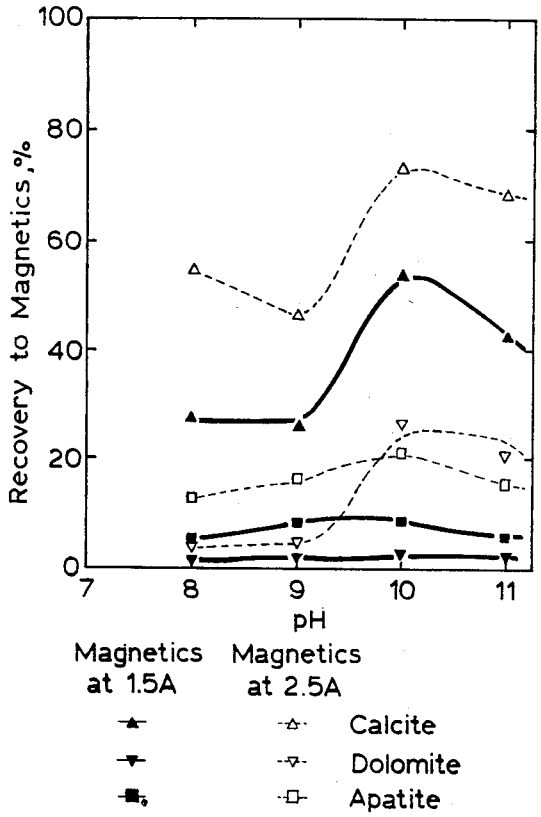
Figure 7:
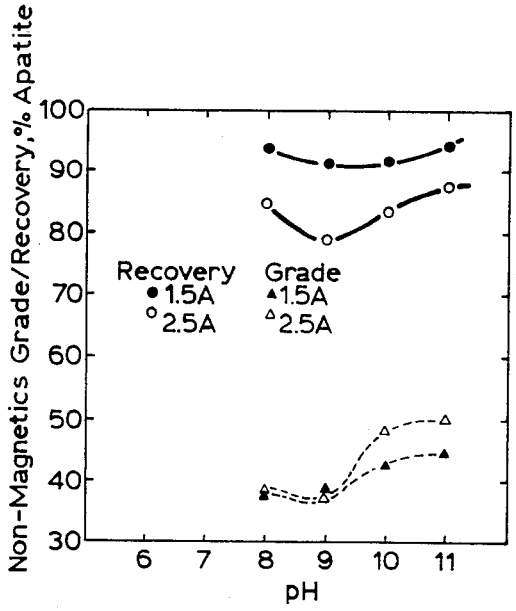
Figure 8:
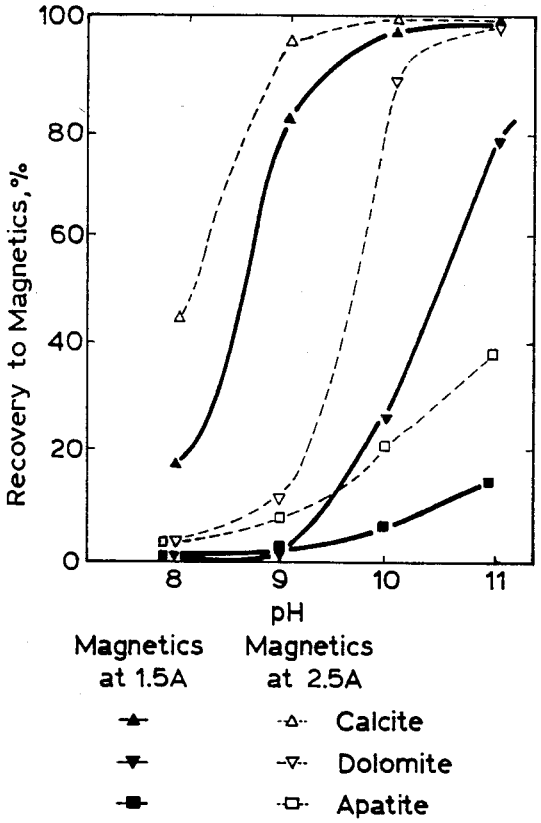
Figure 9:
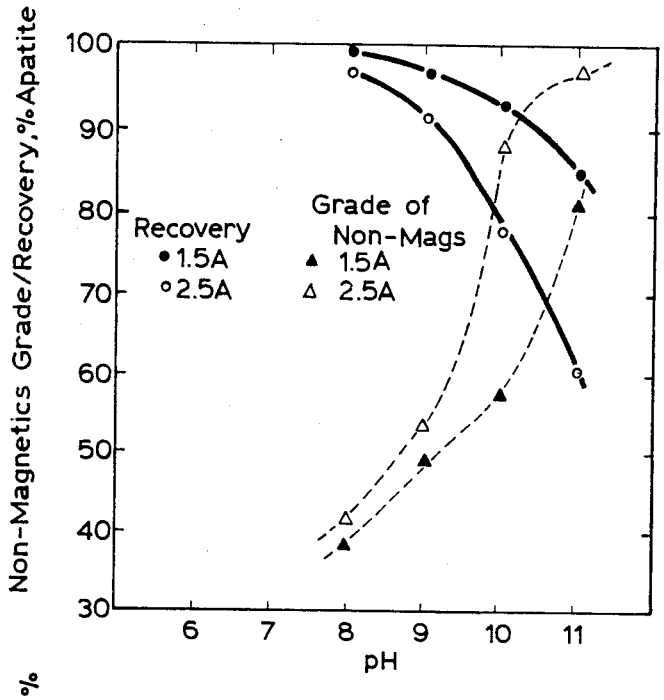
Figure 10:
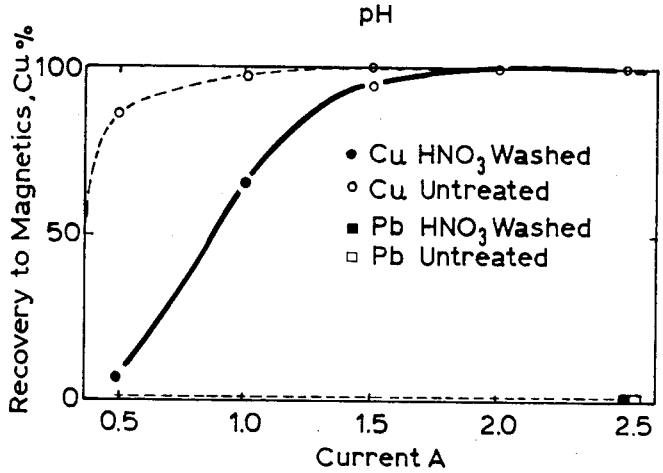
Figure 11:
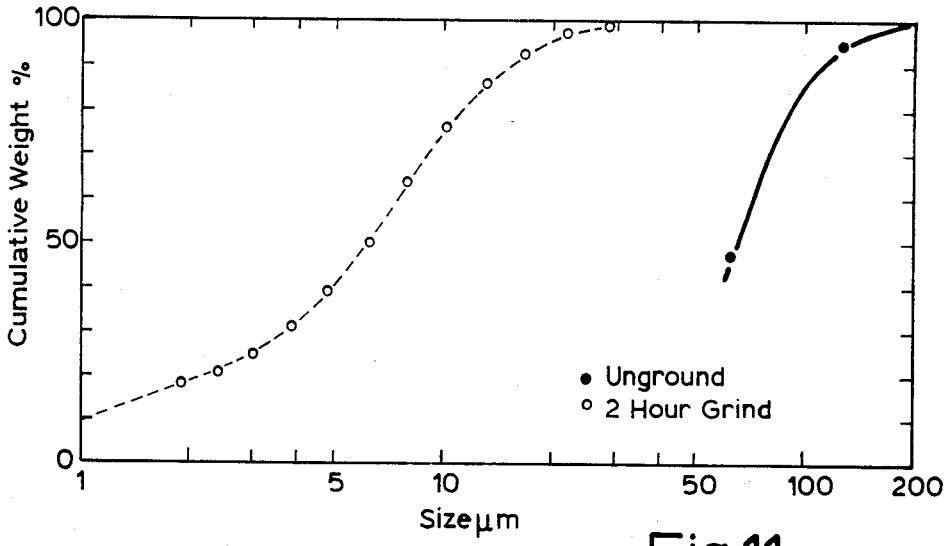
Figure 12:
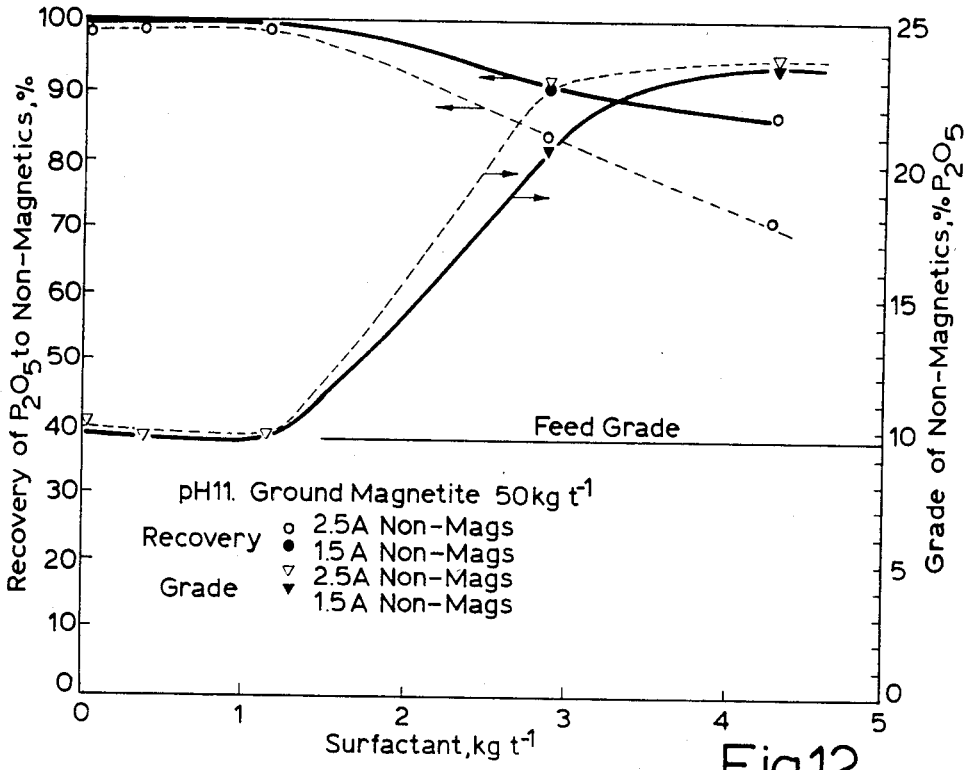
Figure 13:
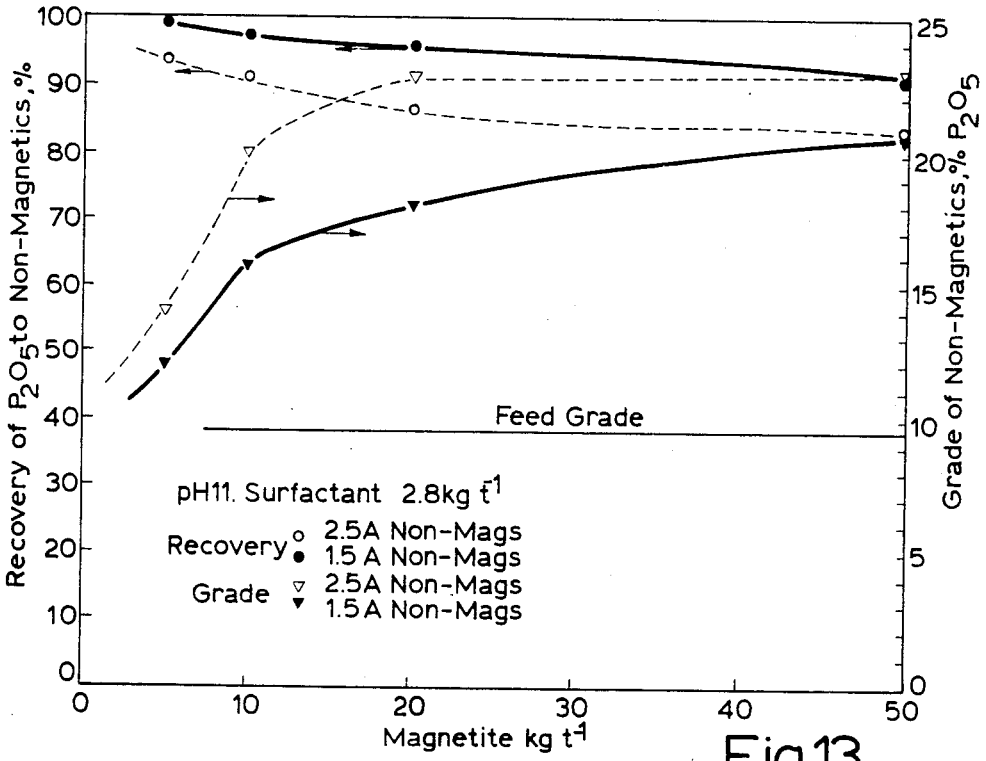

FIG. 2 illustrates zeta-potential of magnetite in water and surfactant solutions for $2\times10^{-3}$M $NaClO_4$, FIG. 3 illustrates the variation of stability of magnetite colloidal suspensions with pH for $2\times10^{-3}$M $NaClO_4$, FIG. 4 is a graph showing the variation of Zeta potentials of calcite, dolomite and apatite with pH for $2\times10^{-3}$M $NaClO_4$, FIG. 5 is a further graphical representation illustrating the variation in potential energy barriers with pH for $2\times10^{-3}$M $NaClO_4$, FIG. 6 is a graph illustrating the effect of pH on the treatment of phosphate-carbonate by magnetic separation, FIG. 7 is a graph illustrating the effect of pH on apatite concentrate grades and recoveries, FIG. 8 is a graph illustrating the effect of pH on the treatment of phosphate-carbonate by magnetic separation in the presence of oleate, FIG. 9 is a further graphical representation of pH on apatite concentrate grades and recoveries in the presence of oleate, FIG. 10 is a graph illustrating the recovery of copper from lead after magnetic coating, FIG. 11 is a graph illustrating the size analysis of magnetite, FIG. 12 is a graph illustrating the effect of surfactant addition on separation, and FIG. 13 is a graph illustrating the effect of magnetite addition on separation.

A method of separating the various constituent materials of a material mixture will be described hereinafter with reference to various experiments although this is preceded by a discussion of the theory supporting such methods.

Selective deposition of fine particles on coarser particles is achieved by control of the interaction engergies between the particles and is a problem of dispersion and heterocoagulation. The interaction energy between two particles is given by $$V_T = V_A + V_R + V_S + V_B + V_M \quad (1)$$

Where $V_T$ is the total interaction energy, $V_A$ is the interaction energy due to van der Waals forces, $V_R$ is the double-layer interaction energy, $V_S$ is the interaction energy due to steric and hydrophobic effects, $V_B$ is the interaction energy due to bridging effects and $V_M$ is the interaction energy due to magnetic effects. For two spherical particles of the same material.

$$V_A = -\frac{Aa_1a_2}{6(a_1 + a_2)H} \quad (2)$$

and $$V_R = \frac{\pi\epsilon_0\epsilon a_1a_2(\psi_1^2 + \psi_2^2)}{(a_1 + a_2)} \quad (3)$$

$$\left[\frac{2\psi_1\psi_2}{(\psi_1^2 + \psi_2^2)} \ln\left(\frac{1 + \exp(-kH)}{1 - \exp(-kH)}\right) + \ln(1 - \exp(-2kH))\right]$$

where A is the Hamaker constant, J;$a_1$ and $a_2$ are particle radii, m;$\psi_1$ and $\psi_2$ are zeta-potentials, V;H is the separation distance, m;K is the Debye-Huckel parameter, $m^{-1}$;$\epsilon$ is relative permittivity and $\epsilon_0$ is permittivity of free space (equal to $8.854\times10^{-1}$ F $m^{-1}$). k is given by $$\left(\frac{8\pi Ce^2Z^2}{\epsilon_0\epsilon kT}\right)^{\frac{1}{2}} \quad (4)$$

where Z is the valency of the counter ion; C is the concentration of ions, $m^{-3}$;e is electronic charge, C,k is the Boltzmann constant, J $K^{-1}$; and T is temperature, K. For minerals that have similar surfaces, such as oxides, it is usually assumed that the Hamaker constant for binary mixtures is similar to that for single components and has a value of about $3\text{–}5\times10^{-20}$ J. Equation 2 is true only for values of $\psi_1$ and $\psi_2$ less than 25 mV, but is a good approximation if they are both less than 60 mV. The product K.a should be greater than 10.

The quantification of steric and bridging effects, $V_S$ and $V_B$, which are caused by organic reagents, with readily determined parameters is not possible at present, although the processes are understood qualitatively quite well. The magnetic interaction, $V_M$, which may be important in determining the stability of magnetite colloids, is $$V_M \cong -\frac{32\pi^2a^6\chi^2B_0^2}{9\mu_0H^3} \quad (5)$$

where X is volume magnetic susceptibility; $B_0$ is magnetic induction, T; $\mu_0$ is the magnetic permeability of free space (equal to $4\eta\times10^{-7}$ $Hm^{-1}$); and a is the radius of the particle. H in this case is the centre to centre separation.

The deposition rate of the magnetic particles depends on the collision rate between them and the particles that are to be coated, which, in turn, is dependent on the shear rate and the concentration of particles; it is also a function of the form of the total interaction energy curve (equation 1). For the condition in which the maximum interaction energy is less than zero the rate of deposition should equal the rate of collision.

The relationship between effective magnetic susceptibility and the magnetite content of rocks can be expressed as $$\chi = (0.0026\ P^{1.11})\frac{4\pi}{10^3}\ SI\ \text{units} \quad (6)$$

where P is the magnetite content, vol%. From this expression it can be calculated that 0.01–0.1 vol% magnetite per particle is needed for nonmagnetic particles to acquire a magnetic susceptibillity similar to that of paramagnetic minerals, such as wolframite or siderite, which have susceptibilities in the range $20\text{–}200\times10^{-8}$ SI units. Slime coatings at this level readily form on particles about 100 μm in diameter under appropriate conditions.

The volume of magnetite that is present in the coating relative to the total volume of the particle is proportional to the surface area of the particle, the fractional coverage, the thickness of the magnetite coating and the packing factor of the magnetite on the particle surface. If the particles are assumed to the spherical, the volume of magnetite may, thus, be described by the expression $$\text{Volume of magnetite} = 4\pi a_1^2\cdot\theta\cdot 2a_2\cdot\phi \quad (7)$$

where $a_1$ is the particle radius, m;$a_2$ is magnetite particle radius, m;$\theta$ is fractional coverage of the surface; and $\phi$ is the packing factor. The packing factor depends on the voids that are left as a consequence of the shape of the magnetite and is a measure of the packing density on the surface. Its value is probably in the range 0.5–0.7.

P, the content of magnetite, vol%, in the coated particle can be expressed in the form $$P = \frac{\text{Volume of magnetite}}{\text{Total volume of particle}} \times 100 \quad (8)$$

which for spherical particles becomes $$P = \frac{100}{1 + \frac{\alpha_1}{6\alpha_2\cdot\theta\cdot\phi}}\ \% \quad (9)$$

FIG. 1 shows the calculated susceptibility of aggregates with differing mineral to magnetite size ratios for different fractional surface coverages. It reveals that for a given magnetite particle size ($a_2$) the effective susceptibility of the coated grains fall logarithmically with increase in the mineral particle size ($a_1$). This may cause difficulties in the separation of wide size ranges of particles. To separate coarser particles a proportionally coarser magnetite should be more effective. For example, at 10% surface coverage ($\theta=0.1$) of 0.1 μm magnetite on 1000 μm particles ($a_1/a_2-10^4$) a magnetic susceptibility of only $5.2\times10^{-8}$ $m^3$ is calculated, whereas the same coverage with 1 μm magnetite ($a_1/a_2=10^3$) produces a susceptibility of $67\times10^{-8}$ $m^3$.

In practical applications of high-gradient magnetic separation the effects of particle size may be less than has been predicted here since the magnetic force that acts on the particle in these separators is greater at the surface, that is in contact with the magnetic matrix, than on equivalent regions of the particles more distant.

EXPERIMENT 1

In this experiment well-crystallized samples of pure calcite, dolomite, apatite, fluorite and quartz were used in testwork. The materials werre prepared by grinding 1 kg lots of −1.7-mm crushed samples in a stainless-steel rod-mill at 50% solids concentration in deionized, doubly distilled water. The ground samples were sized to −150+75 μm by wet screening and stored under water in airtight glass jars out of sunlight. This size fraction was used for all tests referred to here. Copper and lead samples were of spherical shot and the size of the lead was 0.5–1 mm and that of the copper 0.25–0.40 mm.

The method of preparation of the magnetite was based on that of Craik and Griffiths (Craik D. J. and Griffiths P. M. A new colloid for use with the Bitter-figure technique. Proc. Phys. Soc. Lond. 70B, 1957, 1000-2) and Bozorth (Bozorth R. M. Ferromagnetisms (New York: Van Nostrand. 1951), 533). 2 g or $FeCl_2 4H_2O$ and 5.4 g of $FeCl_3 6H_2O$ were dissolved in 300 $cm^3$ doubly distilled water. The solution was heated to 70° C. and 5 g of sodium hydroxide that had been dissolved in 50 $cm^3$ doubly distilled water was added. The precipitated magnetite was washed and centrifuged to remove salt and excess sodium hydroxide. The total volume after washing was 50 $cm^3$ from which alkali-, acid-, oleate- or amine-dispersed colloid could be made.

The alkaline and acid colloids were prepared by making the suspension up to 100 ml at pH 11.3 (with NaOH) and at pH 2.7 (with $HClO_4$), respectively. The oleate colloid was prepared by the addition of 50 ml of $2\times10^{-2}$M sodium oleate, adjustment of the pH to 11.3 and boiling until the magnetite dispersed. For the amine-dispersed colloid 2 g dodecylamine was dissolved in hydrochloric acid, made up to 50 $cm^3$ and added to the washed magnetite suspension. The final pH of the suspension was adjusted to 2.7.

Measurements of electrophoretic mobility was taken with a Rank Bros. Mk II particle electrophoresis apparatus in a flat cell configuration and were convered to zeta-potentials by means of the Smoluchowski equation.

Pure samples of the minerals were ground to 2–5 μm in a McCrone micronizing mill. For the magnetite samples measurements were taken on the colloidal suspension after further dilution with water in the ratio 100:1. The ionic strength of all of the suspension was maintained at $2\times10^{-3}$M with $NaClO_4$. The stability of the suspensions were assessed by measurement of the absorbance of the supernatant at $\lambda=500$ nm after they had been left to stand for 1 hour.

The tests were carried out in a 150 $cm^3$ beaker and a magnetic stirrer was used to keep particles in suspension. No effect of the magnetic stirrer on the stability of the magnetic suspensions was observed. Equal volumes of each mineral (~1.2 g) were used in 100 ml of solution. The pH and ionic strength were controlled with sodium hydroxide, perchloric acid and sodium perchlorate.

The mixtures were conditioned for 5 min at the experiment pH, after which the required volume of magnetite suspension was added and the conditioning continued for a further 10 mins. After the coating period the supernatant was siphoned off and the particles were washed with water at the appropriate pH. The coated product was then separated by a Frantz laboratory magnetic separator, which was operated in the wet mode, in water at the experimental pH, at current settings of 1.5 and 2.5 A, except for the lead-copper products, which were dried and fed to the same apparatus in the dry mode.

The magnetic and non-magnetic material products were analysed by heavy-liquid separation, mixtures of methylene iodide and triethyl orthophosphate being used at specific gravities of 2.8 and 3.0. The copper-lead mixture was analysed by screening at 0.5 mm with subsequent microscopic examination to check the purity of the screen products.

The measured zeta-potentials of the precipitated magnetite in water, sodium oleate and dodecylamine are shown in FIG. 2. The stability of the colloids and the potential energy barrier to coagulation calculated from the zeta-potentials by means of equations 2 and 3 are shown in FIG. 3. The magnetic force, $V_M$, is small in comparison with the other forces for small particles (<1 μm) and has been ignored.

The presence of an anionic surfactant, oleate, results in a more negative zeta-potential in the pH range below 9, this being the range for which ferric oleate is the stable phase. With the cationic dodecylammonium chloride the zeta-potential of the magnetite is positive over the pH range 3–11. At strongly alkaline pH the electrophoretic measurements were made difficult by the precipitation of dodecylamine, which at this concentration begins to occur at pH 9.

The calculated potential energy barriers correspond well with the observed stability in the absence of surfactant and also with $1.08\times10^{-3}$M dodecylammonium chloride. With oleate the suspensions are more unstable in the acid range than was predicted: interactions other than those which were taken into account may occur when the zeta-potential is altered by the adsorption of surfactant ions, these including the interaction between the hydrocarbon chains, which can cause bridging between particles and the effect of hydrophobization of the particle surface on the stability of the water film between two particles that come into contact.

High concentrations of both types of surfactant, such as those of the prepared stock suspensions of the colloids, i.e. 100 time the concentrations to which FIGS. 2 and 3 related, acted as stabilizers and prevented the settling out of the colloid. The concentrations for stabilization were in excess of the critical micelle concentrations of the surfactants.

The results show that the behaviour of magnetite in terms of its zeta-potential, stability and tendency to aggregate can be modified substantially.

The zeta-potentials of apatite, calcite and dolomite are shown in FIG. 4. The calculated potential energy barriers to heterocoagulation of the minerals with magnetite have been calculated from equations 2 and 3 and are shown in FIG. 5. Also shown is the calculated stability of the magnetite itself. For the purposes of calculation it was assumed that the radii of mineral and magnetite particles were 50 and 0.5 μm, respectively. From FIG. 5 it can be predicted that there should be no barrier to the heterocoagulation of magnetite and calcite or dolomite at any pH—in other words, coating of the two carbonates is energetically favourable across the pH range. With apatite, however, a high potential energy barrier is present at pH 10 and 11, which should present the formation of a magnetite coating. This barrier is a consequence of the relatively high negative zeta-potentials of the apatite and magnetite in alkaline solution. It was predicted, accordingly, that if a mixture of calcite and apatite at pH 10–11 were in contact with a suspension of fine magnetite, a magnetic coating should form selectively on the calcite, and experiments were conducted to test this hypothesis.

A mixture of apatite and calcite at pH 11 was conditioned with 25 $cm^3$ of alkaline colloid and then separated magnetically. The results, which are given in Table 1 below, show that an apatite recovery of 85.3% at a grade of 99.3% and a calcite recovery of 87.7% at a grade of 93.3% were achieved. These results were encouraging and demonstrated that the technique was capable of furnishing clean products.

| Magnetic product | Wt % | Grade, % | | Recovery, % | |
|---|---|---|---|---|---|
| | | Calcite | Apatite | Calcite | Apatite |
| Magnetics at 1.0 A | 48.5 | 93.3 | 6.7 | 87.7 | 6.7 |
| Magnetics at 1.0–1.5 A | 9.9 | 61.2 | 38.8 | 11.7 | 7.9 |
| Non-magnetics at 1.5 A | 41.6 | 0.7 | 99.3 | 0.6 | 85.3 |
| Feed | 100.0 | 51.6 | 48.4 | 100.0 | 100.0 |

Table 1 Separation of calcite – apatite mixture at pH 11 after addition of 25 $cm^3$ alkaline magnetic colloid To compare the effects of pH and of the presence of surfactant a series of tests was performed with a mixture of equal amounts of apatite, calcite and dolomite over the pH range 8–11 with and without sodium oleate. A 5 $cm^3$ addition of colloid magnetite was used (which produced a final concentration of $5\times10^{-4}$M oleate for the oleate-dispersed colloid). The results are presented in FIGS. 6–9. Comparison of the results that were obtained for the alkaline colloid with the theoretical stability (FIG. 5) reveals (1)—in the recoveries to the magnetics—that over this pH range calcite takes a greater coating than apatite, that on the latter being small, which is as was predicted; (2) that the response of dolomite is much smaller than expected, recovery at 1.5 being 5% across the pH range; (3) that lower recoveries occur closer to neutral—which may result from tendency of the magnetite to coagulate; and (4) that with the relatively small amount of colloid by comparison with that which was present in the test reported in Table 1 much less of the calcite was rendered magnetic.

The results of the tests in which the colloid was dispersed in oleate before being added (FIGS. 8 and 9) show several interesting features: (1) the degree of coating is much increased, the recovery of the calcite to the 1.5-A magnetics being 98% at pH 10 and 11; (2) the dependence of the separation on pH is much greater than in the absence of oleate; (3) dolomite is much more susceptible to removal at pH 10 and 11, the recovery at 1.5 A being 78%, as compared with 2.5% in the absence of oleate; and (4) at pH 10 and 11 separation of the apatite from the carbonate was achieved. At pH 10 93.2% of the apatite was recovered into the 1.5-A non-magnetics at the grade of 57.8%. At pH 11 the corresponding results were 84.7% recovery at the grade 81.3%.

The results show the importance of the surfactant in reducing the amount of colloid that is required for a useful degree of coating to be obtained; for good separation without the use of surfactant (Table 1) a much higher concentration of magnetite is required.

The method of separation according to the invention was also used with other mixtures of materials to determine the applicability and performance thereof.

More specifically, at pH 5 quartz has a highly negative zeta-potential (−50 mV), fluorite is positive (+40 mV) and magnetite is positive (+35 mV). Under these conditions a magnetite coating is expected to form selectively on the quartz and this prediction was tested with two concentrations of colloid dispersed in acid. The results, which are presented in Table 2, show that the coated material—the magnetic products is >90% pure quartz, but that the recovery of quartz is low and that even with the larger addition of magnetic more that 50% of the quartz is the non-magnetics. As the previous tests had demonstrated that the use of the surfactant could be beneficial, the effect of the oleate-dispersed colloid as examined. Colloid addition took place at two pH values—in the first two tests after adjustment from pH 11.3 to 5 and in the third at the stock pH of 11.3. In the last of these the pH of the mineral suspension rose and needed to be readjusted to pH 5 with perchloric acid. The results of these tests are shown in Table 3. It can be seen from the table that if the colloid is preadjusted to pH 5, the degree of coating is quite small and is also unselective, the most magnetic products containing major amounts of both fluorite and quartz. In the test in which the colloid was added at pH 11.3 and reduced to pH 5 while in contact with the minerals the results are very different and show that efficient selective coating of the fluorite was achieved. Thus, in the absence of oleate quartz is selectively coated, whereas in its presence the fluorite acquires the coating. This may be either a function of the effect of the oleate on the zeta-potentials of the fluorite and the magnetite or a result of the interaction between the hydrophobic coatings that are formed on the minerals.

TABLE 2

Separation of quartz-fluorite mixture at pH 5 after addition of acid magnetite colloid

| colloid addition, ml/100 ml | Magnetic product | Wt % | Grade, % | | Recovery, % | |
|---|---|---|---|---|---|---|
| | | | Quartz | Fluorite | Quartz | Fluorite |
| 10 | Magnetics at 1.5 A | 12.32 | 92.7 | 7.3 | 27.6 | 1.5 |
| | Magnetics at 1.5–2.5 A | | | | | |
| | Non-magnetics at 2.5 A | 87.7 | 34.2 | 65.8 | 72.4 | 98.5 |
| | Feed | 100.0 | 41.4 | 58.6 | 100.0 | 100.0 |
| 25 | Magnetics at 1.5 A | 2.8 | 93.5 | 6.5 | 5.4 | 0.3 |
| | Magnetcis at 2.5 A | 21.5 | 96.6 | 3.4 | 43.2 | 1.4 |
| | Non-magnetics at 2.5 A | 75.7 | 32.6 | 67.4 | 51.4 | 98.2 |
| | Feed | 100.0 | 48.0 | 52.0 | 100.0 | 100.0 |

[a]1.0 wt % 1.5 A + 11.3 wt % over 2.5 A

TABLE 3

Separation of quartz-fluorite mixture at pH 5 after addition of oleate-dispersed colloid

| Colloid addition, ml/100 ml | Magnetic product | Wt % | Grade, % | | Recovery, % | |
|---|---|---|---|---|---|---|
| | | | Quartz | Fluortie | Quartz | Fluorite |
| 10* | Magnetics at 1.5 A | 6.4 | 47.6 | 52.4 | 6.4 | 6.3 |
| | Magnetics at 1.5–2.5 A | 25.5 | 17.6 | 82.4 | 9.5 | 39.8 |

TABLE 3-continued

| Colloid addition, ml/100 ml | Separation of quartz-fluorite mixture at pH 5 after addition of oleate-dispersed colloid | | | | | |
|---|---|---|---|---|---|---|
| | | | Grade, % | | Recovery, % | |
| | Magnetic product | Wt % | Quartz | Fluortie | Quartz | Fluorite |
| | Non-magnetics at 2.5 A | 68.2 | 58.3 | 41.7 | 84.1 | 53.9 |
| | Feed | 100.0 | 47.3 | 52.7 | 100.0 | 100.0 |
| 25* | Magnetics at 1.5 A | 3.3 | 31.3 | 68.7 | 2.2 | 4.3 |
| | Magnetics at 1.5–2.5 A | 19.9 | 13.4 | 86.6 | 6.7 | 32.5 |
| | Non-magnetics at 2.5 A | 76.8 | 56.4 | 43.6 | 92.1 | 63.2 |
| | Feed | 100.0 | 47.0 | 53.0 | 100.0 | 100.0 |
| 10 | Magnetics at 1.5 A | 35.1 | 1.5 | 98.5 | 1.1 | 65.0 |
| | Magnetics at 1.5–2.5 A | 16.6 | 3.9 | 96.1 | 1.4 | 30.0 |
| | Non-magnetics at 2.5 A | 48.3 | 94.4 | 5.6 | 97.5 | 5.0 |
| | Feed | 100.0 | 46.8 | 53.2 | 100.0 | 100.0 |

*pH of colloid adjusted to pH 5 before addition
Colloid added at its stock pH (11.3)

Mixtures of metallic copper and lead are traditionally difficult to separate by standard physical methods. However, a test was performed in which copper and lead shot was conditioned at pH 9 in the presence of 20 $cn^3$ amine-dispersed colloid. Under these conditions a hydrophobic coating is formed on copper but not on lead. The magnetite is also coated with the surfactant (FIG. 2). After conditioning the samples were dried and separated on the Frantz magnetic separator in the dry mode. A second test was carried out in the same manner except that the metals were first treated with 10% nitric acid to remove oxidation products. The results are shown in FIG. 10. Copper was selectively coated. In the acid-treated material a recovery of 99.6% of the copper at a grade of >99.5% was obtained, which indicates almost perfect separation.

The results of these tests show that selective coating by magnetite is achieved in a variety of material mixtures and can lead to pure products by magnetic separation. The required selectivity is achieved by controlling the surface properties of the various solid components so that fine particles of magnetite will adhere preferentially to one of these. The basic requirement is that there should be no energy barrier to the adhesion of the magnetite on the phase that is to be coated and a high energy barrier should be present if no magnetite coating is to form.

For minerals dispersed in aqueous solutions with only simple electrolytes present the conditions under which heterocoagulation will occur may be predicted from equations 2 and 3. In these conditions the principal factor that affects the selectivity of the coating is the control of the zeta-potentials of the minerals and the magnetite. In the examples that have been quoted here the zeta-potentials were controlled by altering the pH of the suspension. Selective coatings can be achieved, as is demonstrated by the results in Tables 1 and 2, but relatively large amounts of magnetite are required to obtain a useful coating.

In the presence of surface-active agent, such as sodium oleate, a much heavier coating is achieved for an equivalent amount of magnetite. The addition of surfactant cannot, however, reduce the energy barrier to heterocoagulation between, for example, calcite and magnetite since it is already zero and the rate of formation of the coating should be equal to the rate of collision between the particles. This suggests that in the absence of surfactant the magnetite particles desorb from the surface at a significant rate with the result that the net rate of adsorption is much lower than the collision rate. On apatite particles, even though they also tend to become coated with oleate, the electrostatic energy barrier will tend to prevent adhesion, but any magnetic particles that do manage to reach the surface will also be more difficult to desorb than they are in the absence of oleate. In simple electrolyte solutions the coating that is formed appears, thus, to be relatively easily removed. This conclusion agrees with recent findings that the force that is needed to separate two hydrophobic surfaces is much greater than that required for hydrophilic surfaces (Israelechivili J. and Pashley R. The hydrophobic interation is long range, decaying exponentially with distance. Nature, Lond, 300, 1982, 341–2).

When large amounts of oleate (greater than the critical micelle concentration) are present the magnetite is heavily coated with multiple layers of absorbed surfactant, which act as protective coatings, preventing the close approach of the magnetic particles and behaving as a dispersant. This is the condition under which the stock magnetite suspensions were kept. With smaller surface coverage lateral association between the hydrocarbon chains or bridging may occur, provided that the zeta-potentials are such that they allow a sufficiently close approach of the particles. This will have the effect of increasing the energy of attraction between the particles and so reduce the rate of desorption of magnetite. Aggregation by surfactant bridging has previously been proposed to account for the reduced stability of colloidal suspensions in the presence of sodium dodecyl sulphonate. When $5\times10^{-4}$M oleate is present adsorption of the surfactant takes place on calcite over the pH range 7–11, but on magnetite significant adsorption occurs only at pH <9.5. The heaviest coating is produced under conditions that are predicted by equations 2 and 3 for heterocoagulation and in which adsorption of the surfactant takes place on the calcite but not on the magnetite. The lower degree of coating that is achieved when the magnetite is adsorbing oleate may be due either to the reduction in the quantity of free oleate in solution or to the fact that under these conditions magnetite tends to coagulate with itself and so be less effective for coating other minerals (FIG. 3(b)).

The lack of success in coating dolomite has not been explained. A coating would be expected on the basis of the heterocoagulation equations to be created in the pH range 7–11, but in practice it was not, expected when oleate was present. In the quartz-fluorite mixture magnetite produced a selective but weak coating on the quartz in the absence of oleate at pH 5—in accordance with the predictions of double-layer theory. Oleate-dispersed magnetite is unstable at pH 5 and tends to aggregate and be less effective for selective coating. By the addition of the oleate colloid at pH 11.3 a more even distribution of the surfactant throughout the system will be achieved and it will tend to adsorb on the fluorite as well as on the magnetite, giving both phases a low negative zeta-potential and a hydrophobic surface, which lead to more efficient and selective coating.

Copper can be coated selectively in the presence of lead, and this may be of commercial interest for separating mixtures of the two metals. The separation efficiencies that were achieved were similar to those which have been obtained with the use of paramagnetic liquids, but in the present method conventional magnetic separators may be used. The size limitations of the present method may prevent magnetic coating being applicable to the separation of coarser metal mixture.

As previously indicated the principle parameters in controlling the selectivity and density of a coating of magnetic material such as magnetite on one component of a mixture of minerals are the zeta potentials of the component minerals and the magnetite, and the hydrophobicity of the particle surfaces. Higher coating densities occur when the interaction energy between the particle and magnetite surfaces is such that no repulsive force exists. If the zeta potential of the magnetite becomes too low however it can coagulate and in such a state is less effective for coating other minerals. The presence of surface active material adsorbed on the phases leads to a more strongly held coating and decreases the amount of magnetite required considerably.

The use of ground mineral magnetite as the coating material has been found to be particularly suitable for the separation of carbonates and phosphate ore. This has a considerable advantage over the chemically produced magnetites in that it is relatively cheap to produce.

Therefore there follows a discussion on a method of separation having particular reference to a mixture of minerals comprising a phosphatic chalk containing pellets of intimately associated phosphate and carbonate in a matrix of calcite, where briefly a selective coating of magnetite was produced on the calcite in the presence of a surfactant at pH 11 and the calcite removed magnetically. Magnetic separation was achieved using a Frantz laboratory magnetic separator modified to operate in the wet mode.

The variation in separation efficiency with surfactant and magnetite concentration were investigated and the results disclosed below. Under optimum conditions separation was achieved which was comparable with the theoretical maximum grade/recovery obtainable as indicated by heavy liquid separation. Reagent consumption was around 2.8 kg/tonne of surfactant and 20–50 kg/tonne magnetite. In practice much of the magnetite is preferably recovered by low intensity magnetic separation prior to the high intensity separation.

Therefore separation of minerals by selectively coating one phase with fine ferromagnetic particles followed by magnetic separation, is a process which has the potential for treating a wide variety of mixtures, including those which are not amenable to treatment by conventional methods.)

More specifically a suspension of fine ferromagnetic particles is added to a conditioned mineral slurry. This is followed by selective absorption of ferromagnetic material onto the surface of the mineral being recovered and then the slurry is passed through a magnetic separator to yield magnetic and non-magnetic components consisting of coated and uncoated particles respectively. Successful separation lies in the selective adsorption stage, as disclosed above and where it was shown that of the separation process is achieved by control of the surface properties of the mineral components, in particular their hydrophobicity and their zeta potential. In the absence of surfactant, deposition of the fine magnetic particles can be predicted from a knowledge of the relevant parameters using classical colloid stability equations (refs 2 and 3). In simplified terms this means controlling the zeta potentials of the minerals and magnetic coating material such that heterocoagulation of the magnetic phase will occur with one mineral but not with another. In the case of apatite and calcite for example, this is achieved at alkaline pH where calcite has a low negative zeta potential (0 to −10 mV), apatite is slightly more negative (−20 to −25 mV) and magnetite has a much higher negative potential (−40 to −50 mV). Under these conditions magnetite will selectively adsorb on the calcite.

The magnetic coating process has been used experimentally for artificial mixtures such as calcite/dolomite/apetite, quartz/fluorite, and mixed metals using chemically precipitated colloidal magnetite as the coating agent. In order to scale up the process for commercial use, it was necessary to investigate the efficiency of the process in the treatment of a real ore sample together with the quantities and costs of reagents. Such investigation was achieved using the following Experiment.

EXPERIMENT 2

In this experiment the material used was a phosphatic chalk containing 8.0% $P_2O_5$. The phosphate was present in the form of impure pellets which have a maximum $P_2O_5$ content of 25–26% and this should be regarded as the maximum grade of phosphate which may be achieved by physical methods. The bulk of the gangue was calcite.

The sample was prepared by crushing to −1.4 mm then scrubbing at 70% solids in distilled water for 5 min. The sizing of the scrubbed product was accomplished by hydrocyclone and wet screening. The size fractions were stored under distilled water.

Fine mineral magnetite was prepared by grinding 500 g of −125 μm (95% passing) magnetite concentrate for 2 hours with 1 liter of water in a 12 inch rod mill. The slurry was made up to 2 liter as the stock magnetite suspension. The size analysis of the ground magnetite is shown in FIG. 11. In cases where surfactant/magnetite mixtures were added they were prepared about 24 hours before use, though this is not essential.

In the method 100 g of scrubbed phosphatic chalk were screened at 250 μm and deslimed at 10 μm using a hydrocyclone to give approximately 80 g of −250 +10 μm feed for each test. This was conditioned in a small baffled conditioning cell with 120 $cm^3$ of water at pH 11 at a stirrer speed of 2000 rpm. After 3 minutes the surfactant/magnetite mixture was added and the total volume made up to 200 $c,^3$, maintaining the pH at 11. After a 10 minute conditioning period the slurry was passed through a Davis Tube magnetic separator using about 1 liter of wash water of pH 11. This low intensity magnetic separations step removes most of the unattached particles of magnetite. The non-magnetic product containing the phosphatic chalk was then further separated magnetically using the Frantz magnetic separator operating in the wet mode.

The variables investigated were surfactant and magnetite additions.

The tests were performed at a high solids concentration and with a wide feed size range (−250 +10 μm). Ground mineral magnetite was used rather than the chemically precipitated form, since this is the most economic source of a magnetic coating agent.

FIG. 12 shows graphically the grade and recoveries achieved using 50 kg/tonne magnetite with increasing additions of a long chain surfactant. Additions are with respect to tonnes of head ore, of which 80% forms the feed to this process. From the results it is clear that a certain amount of surfactant is necessary to obtain any significant increase in phosphate grade above that of the feed. With less than 1.1 kg/tonne surfactant present weight recoveries of the magnetic products were less than 3.5%. Increasing the surfactant addition to 2.8 kg/tonne results in a dramatic increase in the weight of magnetic products with a consequent increase in phosphate grade of the non-magnetics. With further increase in surfactant concentration to 4.2 kg/tonne the grade of non-magnetics approaches the theoretical maximum of 25–26% $P_2O_5$ with some reduction in recovery.

Of the surfactant additions utilised, 2.8 kg $t^{-1}$ surfactant was the lowest which enables a useful magnetic coating to form on the calcite. Using this concentration of surfactant a series of tests was undertaken to examine the effect of lowering the magnetite addition on the efficiency of separation. The results of these tests are shown in FIG. 13. Reducing the addition to 20 kg/tonne magntite produces a lowering grade of the 1.5A non-magnetics to 18% $P_2O_5$ whilst the 2.5A non-magnetics maintain an acceptable grade of 22.7% $P_2O_5$. Magnetite additions of below 20 kg/tonne yield progressively poorer grades.

From these two series of tests it was concluded that for optimum conditions for separation 20–50 kg/tonne magnetite with 1.1–2.8 kg/tonne surfactant will be required in practice for this specific ore.

A surfactant can be added to the material mixture prior to the addition of the magnetic material to the material mixture to pretreat the mixture.

The cost of mineral magnetite varies widely, from zero, if the mineral is present in the ore as it commonly is with phodphate-carbonate deposits of the carbonite type, to £ 50–£ 200/tonne. At a cost of £ 100/tonne, magnetite costs would be in the order of £ 2– £ 5/-tonne. It is considered however that this figure can be much reduced in practice by recycling the magnetite removed in the low intensity magnetic separation stage. This is because only a very small proportion of the magnetite added to the pulp is actually adsorbed; most of the magnetite remains free in suspension and is readily recovered for reuse by the low intensity magnetic stage.

Costs of grinding the magnetite to a suitable size can be estimated using the Bond work index for grindability (F.C. BOND. Crushing and grinding calculations. Brit. Chem. Eng. 6(8), 1961, 543–8)

$$\text{kWh per tonne } 11\, W_i\left(\frac{1}{\sqrt{P}} - \frac{1}{\sqrt{F}}\right) \quad (10)$$

where $W_i$ is the work index, equal to about 10 for magnetite, F is the feed size (80% passing) (m), and P is the product size (80% passing) (μm).

Thus the energy involved in grinding a tonne of 100 μm (80% passing) magnetite feed to 80% passing 10μm (c.f. FIG. 2) was in the order of 25 kWh representing an energy cost of 0.5–1.25 kWh/tonne of ore treated by the process, assuming a magnetite addition of 20–50 kg/tonne. The grinding costs on this basis are only a minor part of the total process costs. The cost of surfactant, at £ 570/tonne, will amount to £ 0.63– £ 1.60-/tonne of ore treated. The use of cheaper surfactants will reduce this part of the cost substantially. Accordingly the reagent costs using ground mineral magnetite are expected to be in the order of several pounds per tonne of ore treated.

It has been disclosed that the process of selective magnetic coating applied to a real ore system gives high grades and recoveries of products using magnetic separation. In the carbonate/phosphate system the selective coating of calcite particle by magnetite is achieved by controlling the pH of the pulp which in turn controls the zeta potential of the calcite, phosphate and magnetite. Coating occurs when the interaction energy of the magnetite and mineral surface is such that no potential energy barrier preventing close approach is present; this having been demonstrated with an articifical mixture of calcite and apatite using a collodial magnetite as the coating agent in which highly efficient separation was achieved (Table 1). Such coatings however can be rather weakly held and subject to removal by vigorous mixing, this effect increasing as the particle size of the coating phase increases. As previously disclosed slime coating is generally heavier and held more tenaciously when the phases have adsorbed long chain surfactants such as oleate, than is the case when the phases are hydrophilic or have been redered hydrophobic using short chain reagents such as ethyl xanthate.

The stability of suspensions whose surface charge has been altered by the adsorption of surfactants is not covered in the conventional treatment of colloidal systems by D.L.V.O. theory where only interactions due to electrical double layer effects and van der Waal's attraction are considered. The presence of the long hydrocarbon chain appears to result in a more stable aggregation resulting in decreased desorption of the coating phase from the mineral surface. The mechanism of the additional attractive force is debatable, it may be due to surfactant bridging or hydrophobic interactions.

The materials to be separated in the present experiment, phosphate/carbonate, were chosen because they are difficult to separate by conventional methods such as flotation. The separations achieved by selective magnetic coating (FIGS. 12 and 13) clearly demonstrate the effectiveness of the new process. Phosphate grades of close to the theoretical maximum of 25–26% for this material, are achieved at recoveries in excess of 80%.

Consideration of the economics of the process has shown that up to 2.8 kg/tonne surfactant is required for optimum separation, this being in the same order as required for flotation of sedimentary phosphates.

Importantly ground mineral magnetite can be used in place of the more costly chemically precipitated magnetite form. Additions of 20–50 kg/tonne are necessary, but of this only a small amount is adsorbed, the bulk being recoverable in the low intensity magnetic stage. The recovered magnetite has potential for recycling although it may need regrinding before use if the finest size fraction has become depleted during the coating stage. It is to be noted specifically that the amount of magnetite which must be adsorbed in order to render a particle sufficiently magnetic to recover by high intensity magnetic separation is very low—in the order of 0.01–0.1% by volume. Hence coated magnetic particles produced by this process will not contain excessive amounts of iron and for most systems contamination of the product by the magnetite will be insignificant.

The effectiveness of magnetic coating as a process to separate phosphate pellets from calcite has been disclosed using a naturally occuring ore.

It has been found possible to use ground mineral magnetite as the coating agent. Separation has been achieved by conditioning the ore with ground magnetite and surfactant at pH 11 to create a magnetic coating on the calcite, followed by treatment using low and high intensity separation. Phosphate grades close to the theoretical maximum of 25–26% $P_2O_5$ have been achieved at recoveries of over 80%, from and 8.0% $P_2O_5$ feed, using reagent additions of 50 kg/tonne magnetite and 2.8 kg/tonne surfactant. Reagent costs on this basis are expected to be several pounds per tonne of ore treated. Much of the magnetite is potentially recoverable for recycling. The effective magnetite size range for separation with this system has been $-250+10$ $\mu$m.

Advantageously, a method of separation of materials in a material mixture has been disclosed in which the selective magnetic coating process has been shown to be capable of producing efficient separation of a real ore using relatively low cost reagents. Furthermore, the process has potential for the separation of any mixture for which the surface properties of the phases are amenable to control. It is envisaged that the main application of the process on an industrial scale will be initially in the treatment of mixtures which are difficult to treat by other surface chemical methods such as flotation or selective flocculation.

I claim:

1. A method of separating the various constituent minerals of a mixture of mineral, comprising chemically adjusting the Zeta potential of the mixture of minerala and adding particles of magnetic material to the mixture, whereupon heterocoagulation of the magnetic particles occurs such that the product of the Zeta potentials of the individual mineral components and the Zeta potential of the magnetic material is effective to cause the magnetic particles to adhere to particles of one mineral component but not the other.

2. A method as claimed in claim 1, wherein the mixture of minerals subjected to separation comprises a mixture of carbonates and phosphate ore.

3. A method as claimed in claim 2, including adding a surfactant to the magnetic material prior to addition of the surfactant/magnetic material to the material mixture.

4. A method as claimed in claim 3, including subjecting the mixture of minerals and magnetic material to an initial step of low intensity magnetic separation to remove unattached particles of said magnetic material.

5. A method as claimed in claim 4, wherein the magnetic material is finely ground particles of magnetite.

6. A method as claimed in claim 3, wherein the surfactant is carboxylic acid having a long carbon chain.

7. A method of separating the various constituent materials of a mixture of carbonates and phosphate ore, comprising chemically adjusting the Zeta potential of the mixture of carbonates and phosphate ore, and introducing into the mixture of carbonate and phosphate ore fine particles of magnetic material such that heterocoagulation of the magnetic particles occurs when the product of the Zeta potentials of the carbonates and phosphates with the Zeta potential of the magnetic particles is such that the particles of magnetic material adhere to one of the particles of carbonates and phosphate ore, and passing the resultant slurry through a magnetic separator to yield separated minerals consisting of magnetically coated particles of carbonates and one of said components of phosphate.

8. A method as claimed in claim 7, including adding a surfactant to the magnetic material prior to addition of the surfactant/magnetic material to the material mixture.

9. A method as claimed in claim 7, including adding a surfactant to the material mixture prior to addition of the magnetic material to the material mixture.

10. A method as claimed in claim 7, including subjecting the said mixture and added magnetic material to low intensity magnetic separation to remove unattached particles of said magnetic material.

11. A method as claimed in claim 8 or 9, wherein the surfactant added to the material mixture is a long chain carboxylic acid.

12. A method as claimed in claim 11, wherein the surfactant is oleate.

13. A method as claimed in claim 9 or 10, wherein the magnetite is used as a magnetic material added to the material mixture to be subjected to separation.

14. A method as claimed in claim 13, wherein the amount of magnetite to be absorbed to render a particle sufficiently magnetic to recover by high intensity magnetic separation is 0.01 to 0.1% by volume.

15. A method as claimed in claim 14, wherein the magnetite comprises finely ground particles of magnetite.

16. A method as claimed in claim 14, wherein the magnetite is precipitated colloidal magnetite.

17. A method as claimed in claim 14, wherein the magnetic material removed during low intensity magnetic separtation is recycled for addition to a subsequent mixture of calcite and phosphate ore.

18. A method as claimed in claim 1 or 7, including adjusting the pH of the components of the mineral mixture to control the value of the Zeta potential of said components.

19. A method as claimed in claim 18, including adjusting the pH in the range 8 to 11.

* * * * *